US007102597B2

(12) United States Patent
Iwami

(10) Patent No.: US 7,102,597 B2
(45) Date of Patent: Sep. 5, 2006

(54) DRIVER DEVICE FOR DRIVING CAPACITIVE LIGHT EMITTING ELEMENTS

(75) Inventor: Takashi Iwami, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 54 days.

(21) Appl. No.: 10/962,531

(22) Filed: Oct. 13, 2004

(65) Prior Publication Data

US 2005/0083257 A1 Apr. 21, 2005

(30) Foreign Application Priority Data

Oct. 16, 2003 (JP) ..... 2003-356034

(51) Int. Cl.
*G09G 3/28* (2006.01)
*G09G 3/30* (2006.01)
*G09G 5/00* (2006.01)

(52) U.S. Cl. ..... 345/60; 345/62; 345/64; 345/76; 345/210

(58) Field of Classification Search ..... 345/60–69, 345/76–82, 204–215; 315/169.1–169.4
See application file for complete search history.

(56) References Cited

U.S. PATENT DOCUMENTS 5,633,659 A * 5/1997 Furuhashi et al. ..... 345/173
5,838,289 A * 11/1998 Saito et al. ..... 345/79
6,329,980 B1 * 12/2001 Uehara et al. ..... 345/204
6,369,515 B1 * 4/2002 Okuda ..... 315/169.3
6,376,994 B1 * 4/2002 Ochi et al. ..... 315/169.1

FOREIGN PATENT DOCUMENTS

| | | |
|---|---|---|
| JP | 9-146490 | 6/1997 |
| JP | 10-274958 | 10/1998 |
| JP | 2002-156941 | 5/2002 |

* cited by examiner

*Primary Examiner*—Vijay Shankar
(74) *Attorney, Agent, or Firm*—Drinker Biddle & Reath LLP

(57) ABSTRACT

A device for driving capacitive light emitting elements includes a plurality of electrical charge recovery switches that send a current corresponding with an electrical charge, which has accumulated in a capacitor, individually to a plurality of drive electrodes connected to the respective capacitive light emitting elements. The electrical charge recovery switches also supply a current corresponding with the electrical charge that has accumulated in each of the capacitive light emitting elements to the capacitor individually via each of the drive electrodes. The driver device also includes a plurality of output buffers that apply a pixel-data-dependent voltage to the drive electrodes. It is determined, for each drive electrode, whether the voltage of the drive electrode has shifted from a high voltage to a low voltage or from a low voltage to a high voltage on the basis of the pixel data. If the voltage shift has occurred on the drive electrode concerned, the associated electric charge recovery switch is set to the ON state over a predetermined period. If no voltage shift has occurred, the electrical charge recovery switch is set to the OFF state.

20 Claims, 7 Drawing Sheets

DRIVER DEVICE FOR DRIVING CAPACITIVE LIGHT EMITTING ELEMENTS

BACKGROUND OF THE INVENTION

1. Field of the Invention

The present invention relates to a device for driving capacitive light emitting elements.

2. Description of the Related Art

Display panels that include capacitive light emitting elements are often called capacitive display panels and marketed as wall-mounted TVs. Typical wall-mounted TVs are plasma display panels (hereinafter called 'PDP') and electroluminescence display panels (hereinafter called 'ELDP').

FIG. 1 of the attached drawings shows part of a driver device that drives a capacitive display panel to emit light by applying a variety of drive pulses to the capacitive display panel. This driver device is disclosed in Japanese Patent Kokai (Laid-Open Application) No. 2002-156941.

In FIG. 1, a PDP 10 has a plurality of row electrodes (not shown) and a plurality of column electrodes $Z_1$ to $Z_m$ arranged to intersect one another. Discharge cells (not shown), which correspond with pixels, are formed at the points of intersection between the row and column electrodes.

A column electrode driver circuit 20 includes a power supply circuit 21, which generates a resonance pulse supply voltage in accordance with switching signals SW1 to SW3, and a pixel data pulse generation circuit 22, which generates a pixel data pulse applied to each of the column electrodes $Z_1$ to $Z_m$ on the basis of the resonance pulse supply voltage.

The pixel data pulse generation circuit 22 includes switching elements $SWZ_1$ to $SWZ_m$ and $SWZ_{10}$ to $SWZ_{m0}$. The switching elements $SWZ_1$ to $SWZ_m$ and $SWZ_{10}$ to $SWZ_{m0}$ are each controlled to become an ON state or an OFF state (turned on or off) individually in accordance with one display line's worth of (m) pixel data bits $DB_1$ to $DB_m$ that designate the states (lit or unlit) of the discharge cells on the basis of an inputted picture signal. Each of the switching elements $SWZ_1$ to $SWZ_m$ enters the ON state as long as the pixel data bit $DB_i$ supplied thereto is logic level 1, for example, and applies the resonance pulse supply voltage of the supply line 2 to the corresponding column electrode $Z_i$ ($Z_1$ to $Z_m$). On the other hand, when the pixel data bit $DB_i$ is logic level 0, the switching element $SWZ_{i0}$ ($SWZ_{10}$ to $SWZ_{m0}$) enters the ON state and applies the ground potential to the corresponding column electrode $Z_i$ ($Z_1$ to $Z_m$). That is, when a resonance pulse supply voltage is applied to the column electrode $Z_i$, a high-voltage pixel data pulse is generated and supplied to the column electrode $Z_i$, and when the ground potential is applied to the column electrode $Z_i$, a low-voltage pixel data pulse is generated and supplied to the column electrode $Z_i$.

The operation of the power supply circuit 21 for generating this resonance pulse supply voltage will be described below.

Switching signals SW1 to SW3 which repeatedly set the switching elements S1 to S3 to the ON state in the order of the switching elements S1, S3, and then S2, are supplied to operate the power supply circuit 21.

When only the switching element S1 enters the ON state in accordance with the switching signal SW1, the capacitor C1 is discharged and the discharge current thereof is released to the power supply line 2 via the coil L1 and diode D1. If the switching element $SWZ_i$ of the pixel data pulse generation circuit 22 is in the ON state, the discharge current flows into the column electrode $Z_i$ of the PDP 10 via the switching element $SWZ_i$, the load capacitor $C_0$ that is parasitic on the column electrode $Z_i$ is charged, and an accumulation of electrical charge occurs within the load capacitor $C_0$. Therefore, the potential of the power supply line 2 gradually rises because of the resonance action caused by the coil L1 and the load capacitor $C_0$. This voltage increase is the rising edge of the high-voltage pixel data pulse.

When the switching element S3 alone enters the ON state in response to the switching signal SW3, a power supply voltage Va generated by a DC power supply B1 is applied to the power supply line 2. The power supply voltage Va is the maximum voltage of the high-voltage pixel data pulse.

When the switching element S2 alone enters the ON state in response to the switching signal SW2, the load capacitor $C_0$ that is parasitic on the column electrode $Z_i$ of the PDP 10 is discharged. The discharge current flows into the capacitor C1 via the column electrode $Z_i$, the switching element $SWZ_i$, the power supply line 2, the coil L2, the diode D2, and the switching element S2, whereby the capacitor C1 is charged. That is, the electrical charge that has accumulated in the load capacitor $C_0$ of the PDP 10 is gradually recovered by the capacitor C1 provided in the power supply circuit 21. The voltage of the power supply line 2 gradually drops in accordance with the time constant that is determined by the coil L2 and load capacitor $C_0$. This decrease of the voltage is the trailing edge of the high-voltage pixel data pulse.

That is, in the power supply circuit 21, the electrical charge that has accumulated in the PDP 10 as a capacitive load is recovered by the capacitor C1 and reused, whereby a reduced consumption of electrical power is achieved.

When the switching element $SWZ_1$ enters the ON state in response to the pixel data bit $DB_1$ of logic level 1, for example, the resonance pulse supply voltage, whose variation between the leading and trailing edges thereof is gradual and whose maximum voltage is Va, is supplied to the column electrode $Z_1$ as a high-voltage pixel data pulse. On the other hand, when the pixel data bit $DB_1$ is logic level 0, the switching element $SWZ_{10}$ enters the ON state, and therefore a low-voltage (ground potential) pixel data pulse is applied to the column electrode $Z_1$. Part of the electrical charge that has accumulated in the load capacitor $C_0$ of the PDP 10 is consumed via the current path including the column electrode $Z_1$ and switching element $SWZ_{10}$. Therefore, if the bit data train for the display lines of the pixel data bit $DB_1$ is successively logic level 1 such as '1,1,1, . . . , 1,1,1', the switching element $SWZ_1$ is fixed in the ON state and the $SWZ_{10}$ in the OFF state during this interval. As a result, all the electrical charge that has accumulated in the load capacitor $C_0$ of the PDP 10 is not recovered by the capacitor C1. Thus, the resonance pulse supply voltage applied to the power supply line 2 maintains the maximum voltage Va but the resonance amplitude gradually decreases. This is equal to applying a DC power supply voltage to the power supply line 2 (DC drive state).

Accordingly, when a certain type of image should be displayed, a resonance circuit that includes the capacitor C1, coils L1 and L2 and the load capacitor $C_0$ of the PDP 10 enters the DC drive state and this creates the risk of a faulty operation due to the localized generation of heat, noise generation, and so forth.

SUMMARY OF THE INVENTION

One object of the present invention is to provide a driver device for driving capacitive light emitting elements that can achieve size reduction, increased reliability and reduced electrical power consumption while heat radiation is suppressed.

According to one aspect of the present invention, there is provided an improved driver device for driving a plurality of capacitive light emitting elements by applying a plurality of drive pulses to the capacitive light emitting elements via a plurality of drive electrodes in accordance with pixel data derived from an inputted picture signal. The driver device includes an electrical charge recovery circuit that has a capacitor, to one end of which a reference voltage is applied and a coil, one end of which is connected to the other end of the capacitor. The driver device also includes a plurality of electrical charge recovery switches provided for the drive electrodes respectively. Each electric charge recovery switch has a first switching element associated with one drive electrode to send a current corresponding with electrical charge that has accumulated in the capacitor to the associated drive electrode via the other end of the coil. Each electric charge recovery switch also has a second switching element that sends a current corresponding with electrical charge that has accumulated in the associated capacitive light emitting element to the other end of the coil via the associated drive electrode. The driver device also includes a plurality of output buffers provided for the drive electrodes respectively. Each output buffer has a third switching element that applies a predetermined high voltage to the associated drive electrode in accordance with the pixel data. Each output buffer also has a fourth switching element that applies the reference voltage to the associated drive electrode in accordance with the pixel data. The driver device also includes a drive control circuit that determines, for each of the drive electrodes, whether a voltage of the drive electrode concerned has shifted from the high voltage to the low voltage or from the low voltage to the high voltage on the basis of the pixel data. If the voltage shift has occurred on the drive electrode concerned, the drive control circuit sets either the first or second switching element of the electrical charge recovery switch associated with the drive electrode to the ON state over a predetermined period. If the voltage shift has not occurred on the drive electrode concerned, the drive control circuit sets the first and second switching elements of the electrical charge recovery switch associated with the drive electrode to the OFF state.

These and other objects, aspects and advantages of the present invention will become apparent to those skilled in the art from the following detailed description and appended claims when read and understood in conjunction with the attached drawings.

BRIEF DESCRIPTION OF THE DRAWINGS

Similar reference numerals and symbols are used to designate similar elements in FIG. 1 to FIG. 7.

DETAILED DESCRIPTION OF THE INVENTION

Figure 2:
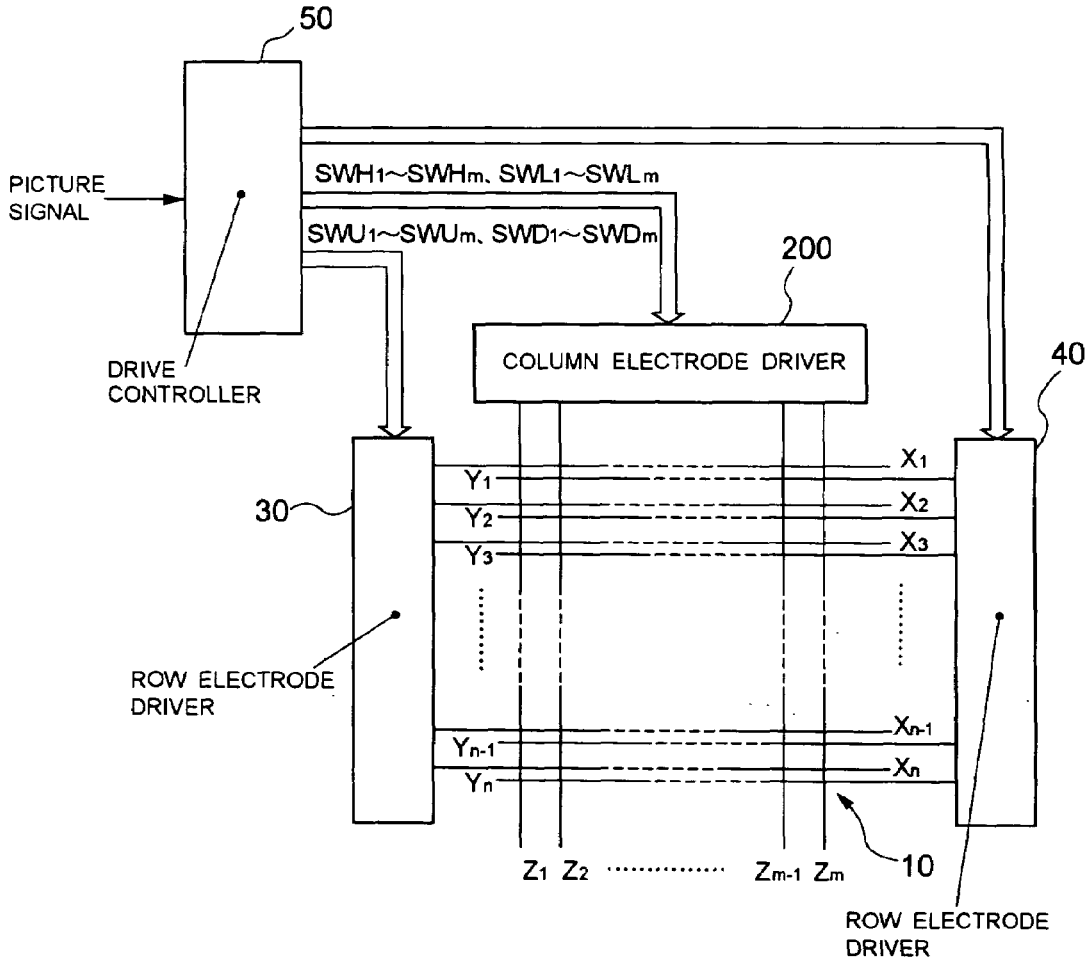
FIG. 2 shows the schematic constitution of a display device that adopts a PDP as a display panel having a plurality of capacitive light emitting elements.

Referring to FIG. 2, a display device that adopts a PDP as a display panel having a plurality of capacitive light emitting elements will be described.

In FIG. 2, a PDP 10 includes a plurality of row electrodes $Y_1$ to $Y_n$ and $X_1$ to $X_n$, which are arranged to extend in the row (width) direction of the screen, and a plurality of column electrodes $Z_1$ to $Z_m$, which are arranged to extend in the column (height) direction of the screen. Discharge spaces (not shown) are interposed between the row electrodes $Y_1$ to $Y_n$ and $X_1$ to $X_n$ and the column electrodes $Z_1$ to $Z_m$. The row electrodes $Y_1$ to $Y_n$ and $X_1$ to $X_n$ are orthogonal to the column electrodes $Z_1$ to $Z_m$. A single display line is defined by a pair of row electrodes $X_i$ and $Y_i$. That is, n display lines consisting of first to nth display lines is formed in the PDP 10. Discharge cells are formed at the points of intersection between the display lines and the column electrodes Z. The discharge cells serve as pixels. That is, discharge cells corresponding with respective pixels are formed in the PDP 10 in the form of a matrix with n rows and m columns.

A first row electrode driver circuit 30 generates a sustaining pulse, which allows only those discharge cells in which a wall charge remains to discharge, and applies the sustaining pulse to the row electrodes $X_1$ to $X_n$ of the PDP 10. A second row electrode driver circuit 40 generates a reset pulse, which initializes all the discharge cells, a scanning pulse, which sequentially selects one display line that becomes the pixel data write target, and a sustaining pulse, which allows only those discharge cells in which a wall charge remains to discharge. The second row electrode driver circuit 40 then applies these pulses to the row electrodes $Y_1$ to $Y_n$.

A drive control circuit 50 generates switching signals (as described later) $SWH_1$ to $SWH_m$, $SWL_1$ to $SWL_m$, $SWU_1$ to $SWU_m$, and $SWD_1$ to $SWD_m$ on the basis of an inputted picture signal and supplies these switching signals to the column electrode driver circuit 200.

The column electrode driver circuit 200 generates m pixel data pulses corresponding with the first to mth columns of the PDP 10 in accordance with the switching signals $SWH_1$ to $SWH_m$, $SWL_1$ to $SWL_m$, $SWU_1$ to $SWU_m$, and $SWD_1$ to $SWD_m$ and applies these pixel data pulses to the column electrodes $Z_1$ to $Z_m$ of the PDP 10. The discharge cells belonging to the row electrode $Y_i$ to which the scanning pulse is applied are selectively discharged in accordance with the pixel data pulses. Specifically, those discharge cells to which the scanning pulse and a high-voltage pixel data pulse are applied are discharged, and other discharge cells to which the scanning pulse and a low-voltage pixel data pulse are applied are not discharged. Depending on the occurrence/absence of this discharge, each of the discharge cells is set to either a state where a wall charge is not present or a state where a wall charge remains. Each time a sustaining pulse is applied by the row electrode driver circuits 30 and 40, only those discharge cells in which electrical charge remains are discharged to emit light.

Figure 3:
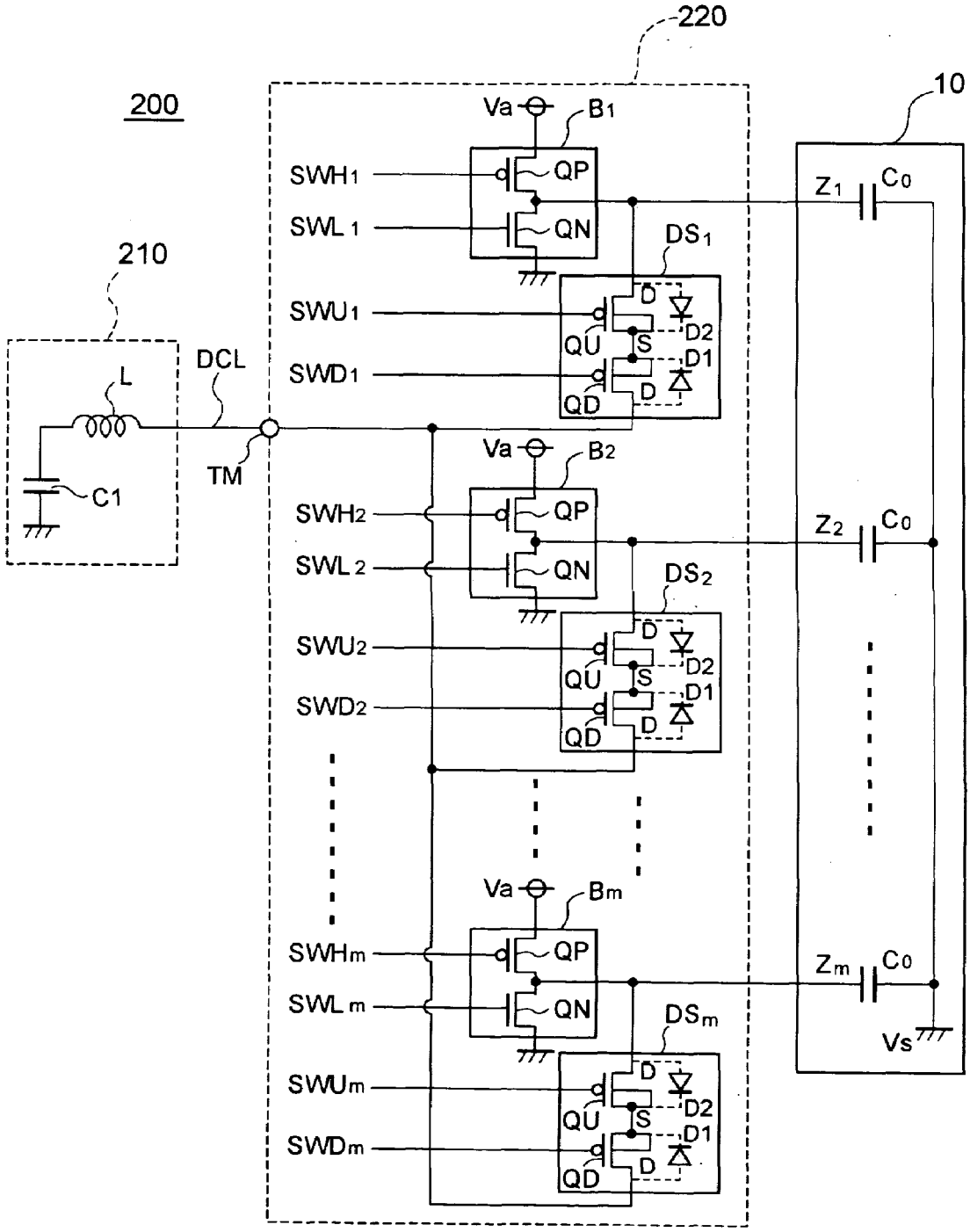
FIG. 3 shows the internal constitution of a column electrode driver circuit shown in FIG. 2.

FIG. 3 shows the internal configuration of the column electrode driver circuit 200. The column electrode driver 200 is the driver device of the present invention.

As shown in FIG. 3, the column electrode driver circuit 200 includes an electrical charge recovery circuit 210 and a pixel data pulse generation circuit 220.

The electrical charge recovery circuit 210 has a capacitor C1 and an inductance coil L.

One electrode of the capacitor C1 is grounded at the ground potential Vs of the PDP 10 and the other electrode is connected to one end of the coil L. The other end of the coil L is electrically connected via a discharge/charge line DCL to a discharge/charge terminal TM that is provided in the pixel data pulse generation circuit 220.

The pixel data pulse generation circuit 220 includes m output buffers $B_1$ to $B_m$ corresponding with the column electrodes $Z_1$ to $Z_m$ of the PDP 10, m electrical charge recovery switches $DS_1$ to $DS_m$, and the discharge/charge terminal TM. The terminal TM is an external terminal.

Each of the output buffers $B_1$ to $B_m$ includes a p-channel-type MOS (Metal Oxide Semiconductor) transistor QP (referred to simply as 'transistor QP' hereinafter) and an n-channel-type MOS transistor QN (hereinafter referred to simply as 'transistor QN'). As shown in FIG. 3, the DC power supply voltage Va is applied to the source electrode of the transistor QP of each output buffer $B_i$, and the source electrode of the transistor QN of each output buffer $B_i$ is grounded at ground potential Vs. In each output buffer $B_i$, the drain electrode of the transistor QP is connected to the drain electrode of the transistor QN, the node between these drain electrodes being the output terminal of the output buffer $B_i$. The column electrode $Z_i$ ($Z_1$ to $Z_m$) is connected to the output terminal of the corresponding output buffer $B_i$ ($B_1$ to $B_m$) A switching signal $SWH_i$ is supplied to the gate electrode of the transistor QP of the corresponding output buffer $B_i$. Specifically, the switching signal $SWH_1$ is supplied to the gate electrode of the transistor QP of the output buffer $B_1$, the switching signal $SWH_2$ is supplied to the gate electrode of the transistor QP of the output buffer $B_2$, and the switching signal $SWH_3$ is supplied to the gate electrode of the transistor QP of the output buffer $B_3$. A switching signals $SWL_i$ is supplied to the gate electrode of the transistor QN of the corresponding output buffer $B_i$. That is, the switching signal $SWL_1$ is supplied to the gate electrode of the transistor QN of the output buffer $B_1$, the switching signal $SWL_2$ is supplied to the gate electrode of the transistor QN of the output buffer $B_2$, and the switching signal $SWL_3$ is supplied to the gate electrode of the transistor QN of the output buffer $B_3$.

Thus, when a switching signal $SWH_i$ of logic level 0 is supplied to the output buffer $B_i$ by the drive control circuit 50, the output buffer $B_i$ applies the power supply voltage Va to the column electrode $Z_i$ of the PDP 10 via the output terminal of the output buffer $B_i$. On the other hand, when a switching signal $SWL_i$ of logic level 1 is supplied to the output buffer $B_i$, the output buffer $B_i$ applies the ground potential Vs to the column electrode $Z_i$ of the PDP 10 via the output terminal of the output buffer $B_i$.

Each of the electrical charge recovery switches $DS_1$ to $DS_m$ includes a p-channel-type MOS transistor QU (hereinafter referred to simply as 'transistor QU') and a p-channel-type MOS transistor QD (hereinafter referred to simply as 'transistor QD'). The source electrodes S of the transistors QU and QD are connected to one another.

The drain electrodes D of the transistors QD of the electrical charge recovery switches $DS_1$ to $DS_m$ are commonly connected to the discharge/charge terminal TM. The drain electrode D of the transistor QU of each electrical charge recovery switch $DS_i$ is connected to the corresponding column electrode $Z_i$. In each of the electrical charge recovery switches $DS_1$ to $DS_m$, the source electrodes S of the transistors QU and QD are connected to one another. The source electrode S of the transistor QU is also connected to an n-channel-type semiconductor formation region where the transistor QU is constructed, and the source electrode S of the transistor QD is also connected to an n-channel-type semiconductor formation region where the transistor QD is constructed. A switching signal $SWU_i$ is supplied to the gate electrode of the transistor QU in the corresponding electrical charge recovery switch $DS_i$. That is, the switching signal $SWU_1$ is supplied to the gate electrode of the transistor QU of the electrical charge recovery switch $DS_1$, the switching signal $SWU_2$ is supplied to the gate electrode of the transistor QU of the electrical charge recovery switch $DS_2$, and the switching signal $SWU_3$ is supplied to the gate electrode of the transistor QU of the electrical charge recovery switch $DS_3$. On the other hand, a switching signal $SWD_i$ is supplied to the gate electrode of the transistor QD in the corresponding electrical charge recovery switch $DS_i$. That is, the switching signal $SWD_1$ is supplied to the gate electrode of the transistor QD of the electrical charge recovery switch $DS_1$, the switching signal $SWD_2$ is supplied to the gate electrode of the transistor QD of the electrical charge recovery switch $DS_2$, and the switching signal $SWD_3$ is supplied to the gate electrode of the transistor QD of the electrical charge recovery switch $DS_3$.

Next, the actual operation of the electrical charge recovery circuit 210 and pixel data pulse generation circuit 220 will be described.

First, the drive control circuit 50 converts an inputted picture signal to 8-bit pixel data, for example, for each pixel and divides the pixel data into respective bit digits to obtain pixel data bits DB. Next, the drive control circuit 50 determines, for each column, the logic level of each pixel data bit DB in the pixel data bit string in the order of the display lines. The pixel data bit string is a (vertical) string of pixel data bits DB with respect to the first to nth display lines that belong to the column concerned. The drive control circuit 50 then determines whether the logic level has shifted from 0 to 1 or from 1 to 0.

Figure 4A:
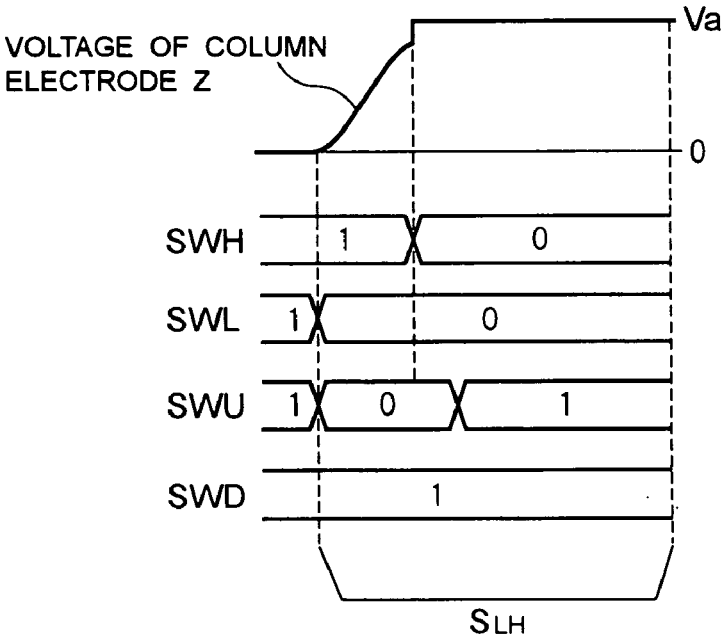
FIG. 4A shows a switching sequence for creating a leading edge of a pixel data pulse.

If the drive control circuit 50 determines that a shift from logic level 0 to 1 occurs, the drive control circuit 50 supplies the switching signals SWH, SWL, SWU and SWD that are indicated by the switching sequence $S_{LH}$ in FIG. 4A to the output buffer B and electrical charge recovery switch DS that belong to the column concerned.

According to this switching sequence $S_{LH}$, the transistors QP and QN of the output buffer B first both enter an OFF state in accordance with the logic-level-0 switching signal SWL and the logic-level-$_1$ switching signal SWH. The transistors QD and QU of the electrical charge recovery switch DS enter the OFF state and ON state respectively in accordance with the logic-level-0 switching signal SWU and the logic-level-$_1$ switching signal SWD. Accordingly, a current that corresponds with the electrical charge that has accumulated in the capacitor C1 of the electrical charge recovery circuit 210 flows into the column electrode Z via the coil L, discharge/charge terminal TM, the parasitic diode D1 that is parasitic across the drain and source of the transistor QD, and the transistor QU, whereby the load capacitor $C_0$ that is parasitic on the column electrode Z is charged. Therefore, under the resonance action of the coil L and load capacitor $C_0$, the voltage of the column electrode Z gradually rises as shown in FIG. 4A. This voltage increase is the leading edge of the pixel data pulse. That is, the leading edge of the pixel data pulse is generated by using the electrical charge that has accumulated in the capacitor C1 of the electrical charge recovery circuit 210. Next, when the switching signal SWH shifts from logic level 1 to logic level 0, the transistor QP of the output buffer B enters the ON state and the power supply voltage Va is applied directly to the column electrode Z. The power supply voltage Va is the maximum voltage value of the high-voltage pixel data pulse. Thereafter, the switching signal SWU switches from logic level 0 to logic level 1 and the transistors QD and QU of the electrical charge recovery switch DS both enter the OFF state. As a result, the release of the electrical charge from the capacitor C1 of the electrical charge recovery circuit 210 to the load capacitor $C_0$ of the PDP 10 ends.

Figure 4B:
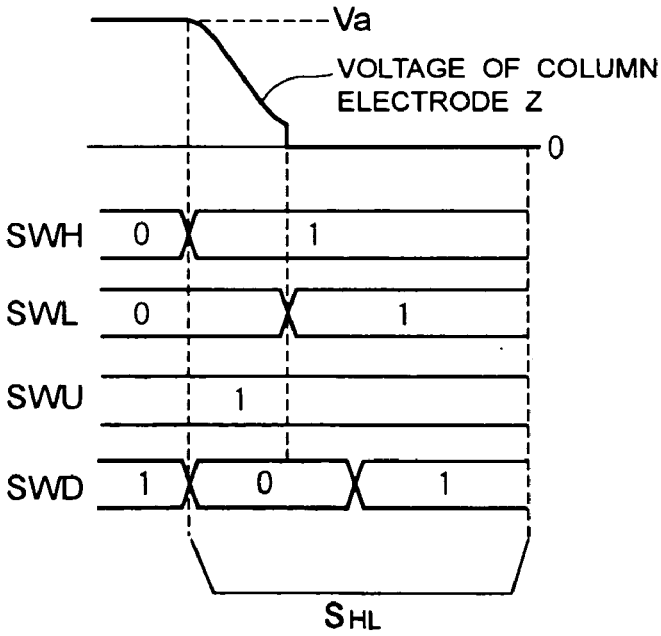
FIG. 4B shows a switching sequence for creating a trailing edge of the pixel data pulse.

On the other hand, when it is determined that the logic level of the pixel data bit DB has shifted from 1 to 0, the drive control circuit 50 generates switching signals SWH, SWL, SWU and SWD as indicated by the switching sequence $S_{HL}$ of FIG. 4B.

According to this switching sequence $S_{HL}$, the transistors QP and QN of the output buffer B first both enter the OFF state in accordance with the logic-level-0 switching signal SWL and the logic-level-1 switching signal SWH. The transistors QU and QD of the electrical charge recovery switch DS enter the OFF state and the ON state respectively in accordance with the logic-level-0 switching signal SWD and logic-level-1 switching signal SWU. As a result, a current that corresponds with the electrical charge that has accumulated in the load capacitor $C_0$ of the PDP 10 flows into the capacitor C1 via the column electrode Z, the parasitic diode D2 that is parasitic across the drain and source of the transistor QU, the transistor QD, the discharge/charge terminal TM, and the coil L, whereby the capacitor C1 is charged. Therefore, under the resonance action of the coil L and load capacitor $C_0$, the voltage of the column electrode Z gradually drops as shown in FIG. 4B. This voltage decrease is the trailing edge of the pixel data pulse. That is, the trailing edge of the pixel data pulse is generated as a result of recovery of the electrical charge, that has accumulated in the load capacitor $C_0$ of the PDP 10, by the capacitor C1 of the electrical charge recovery circuit 210. When the switching signal SWL shifts from logic level 0 to 1, the transistor QN of the output buffer B enters the ON state and the column electrode Z is grounded at 0 volt. The 0 volt is the low-voltage pixel data pulse. Thereafter, the switching signal SWD switches from logic level 0 to logic level 1 and the transistors QD and QU of the electrical charge recovery switch DS both enter the OFF state. Accordingly, the electrical charge recovery from the load capacitor $C_0$ of the PDP 10 by the capacitor C1 of the electrical charge recovery circuit 210 ends.

Figure 5A:
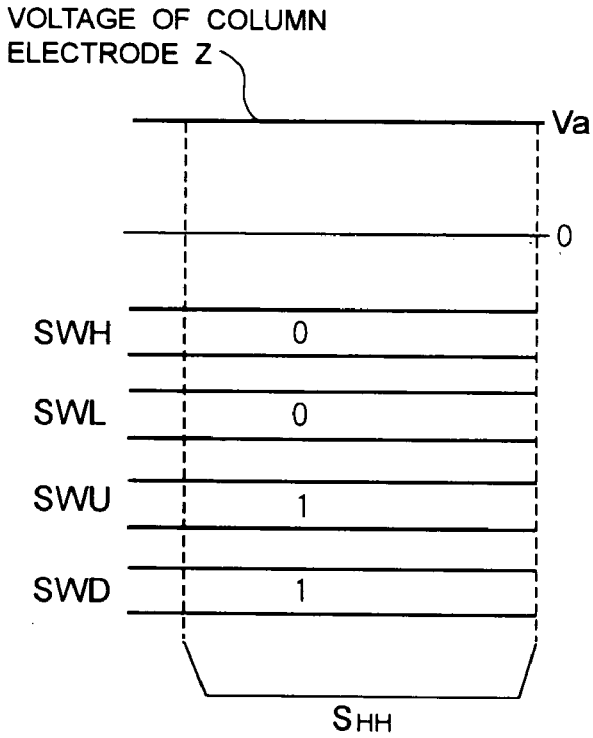
FIG. 5A shows another switching sequence for creating the leading edge of the pixel data pulse in a different situation.
Figure 5B:
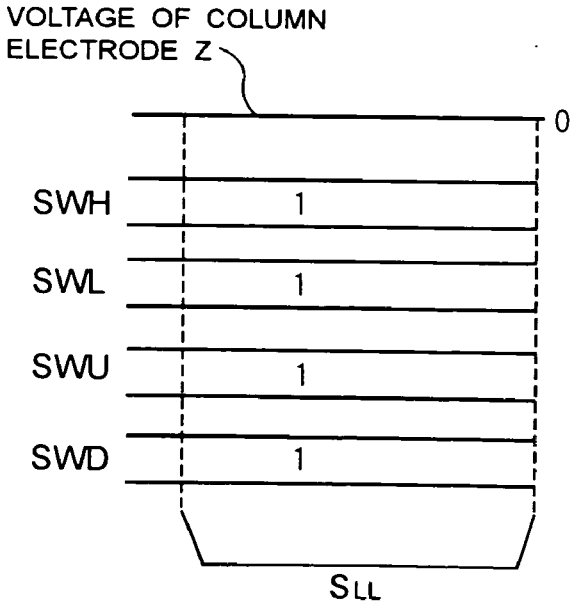
FIG. 5B shows another switching sequence for creating the trailing edge of the pixel data pulse.

When the logic levels of the pixel data bits DB detected in the display line order are successively 1, the electrical charge recovery switches DS and output buffers B are controlled in accordance with the switching sequence $S_{HH}$ as shown in FIG. 5A. As a result of this control, the transistors QD and QU of the electrical charge recovery switches DS both enter the OFF state and the transistors QP of the output buffers B enter the ON state, such that the power supply voltage Va is applied directly to the column electrodes Z. Because the transistors QD and QU of the electrical charge recovery switches DS are both in the OFF state, the electrical charge recovery is not effected by the electrical charge recovery circuit 210. On the other hand, when the logic levels of the pixel data bits DB detected in the display line order are successively 0, the electrical charge recovery switches DS and output buffers B are controlled in accordance with the switching sequence $S_{LL}$ as shown in FIG. 5B. As a result of this control, the transistors QD and QU of the electrical charge recovery switches DS both enter the OFF state and the transistors QN of the output buffers B enter the ON state, whereby the column electrodes Z are set at ground potential (0 volt).

The drive control circuit 50 executes the above described drive individually with respect to the electrical charge recovery switches $DS_1$ to $DS_m$ and the output buffers $B_1$ to $B_m$ on the basis of the pixel data bits $DB_1$ to $DB_m$ that correspond with the first to mth columns of the PDP 10.

Figure 6:
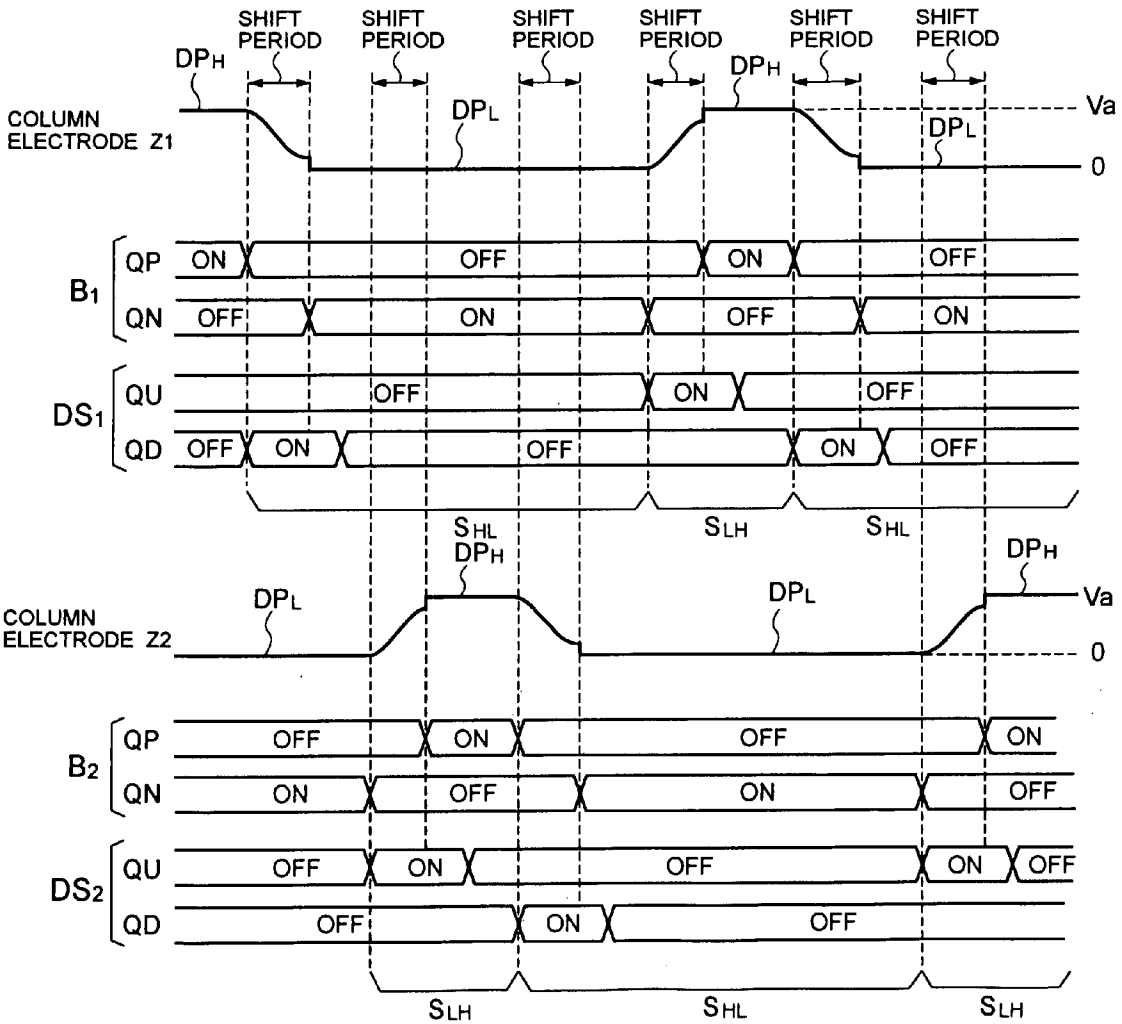
FIG. 6 shows the operation of an electrical charge recovery switch and output buffer in the column electrode driver circuit shown in FIG. 3.

FIG. 6 shows part of the operation based on the switching sequences $S_{HL}$ and $S_{LH}$, which are carried out on the electrical charge recovery switches $DS_1$ and $DS_2$ and output buffers $B_1$ and $B_2$ associated with the column electrodes $Z_1$ and $Z_2$ respectively. In FIG. 6, it should be assumed that the string of pixel data bits $DB_1$, which corresponds with the display lines belonging to the first column of the PDP 10, is '1,0,1,0' and the string of pixel data bits $DB_2$, which correspond with the respective display lines belonging to the second column, is '0,1,0,1'.

As shown in FIG. 6, when the string of the pixel data bits $DB_1$ is '1,0,1,0', the switching sequences $S_{HL}$ and $S_{LH}$ are executed alternately on the electrical charge recovery switch $DS_1$ and the output buffer $B_1$. As a result, a high-voltage (power supply voltage Va) pixel data pulse $DP_H$ corresponding with a logic-level-1 pixel data bit $DB_1$ and a low-voltage (0 volt) pixel data pulse $DP_L$ corresponding with a logic-level-0 pixel data bit $DB_1$ are alternately repeated and applied to the column electrode $Z_1$. Meanwhile, if the string of the pixel data bits $DB_2$ is '0,1,0,1', the switching sequences $S_{LH}$ and $S_{HL}$ are executed alternately on the electrical charge recovery switch $DS_2$ and the output buffer $B_2$ as shown in FIG. 6. As a result, the low-voltage (0 volt) pixel data pulse $DP_L$ corresponding with a logic-level-0 pixel data bit $DB_2$ and the high-voltage (power supply voltage Va) pixel data pulse $DP_H$ corresponding with a logic-level-1 pixel data bit $DB_2$ are repeated alternately and applied to the column electrode $Z_2$.

As shown in FIG. 6, the timing to shift the voltage of the column electrode $Z_1$ from a high voltage (power supply voltage Va) to a low voltage (0 volt) and the timing to shift the voltage of the column electrode $Z_2$ from a low voltage to a high voltage are shifted (offset) with respect to one another. In addition, the timing to shift the voltage of the column electrode $Z_1$ from a low voltage (0 volt) to a high voltage (power supply voltage Va) and the timing to shift the voltage of the column electrode $Z_2$ from a high voltage to a low voltage are shifted with respect to one another. That is, the drive control circuit 50 sets the transistor QU in one electrical charge recovery switch DS and the transistor QD in another electrical charge recovery switch DS to the ON state at different timings. Further, the drive control circuit 50 sets the transistor QD in one electrical charge recovery switch DS and the transistor QU in another electrical charge recovery switch DS to the ON state at different timings.

Figure 7:
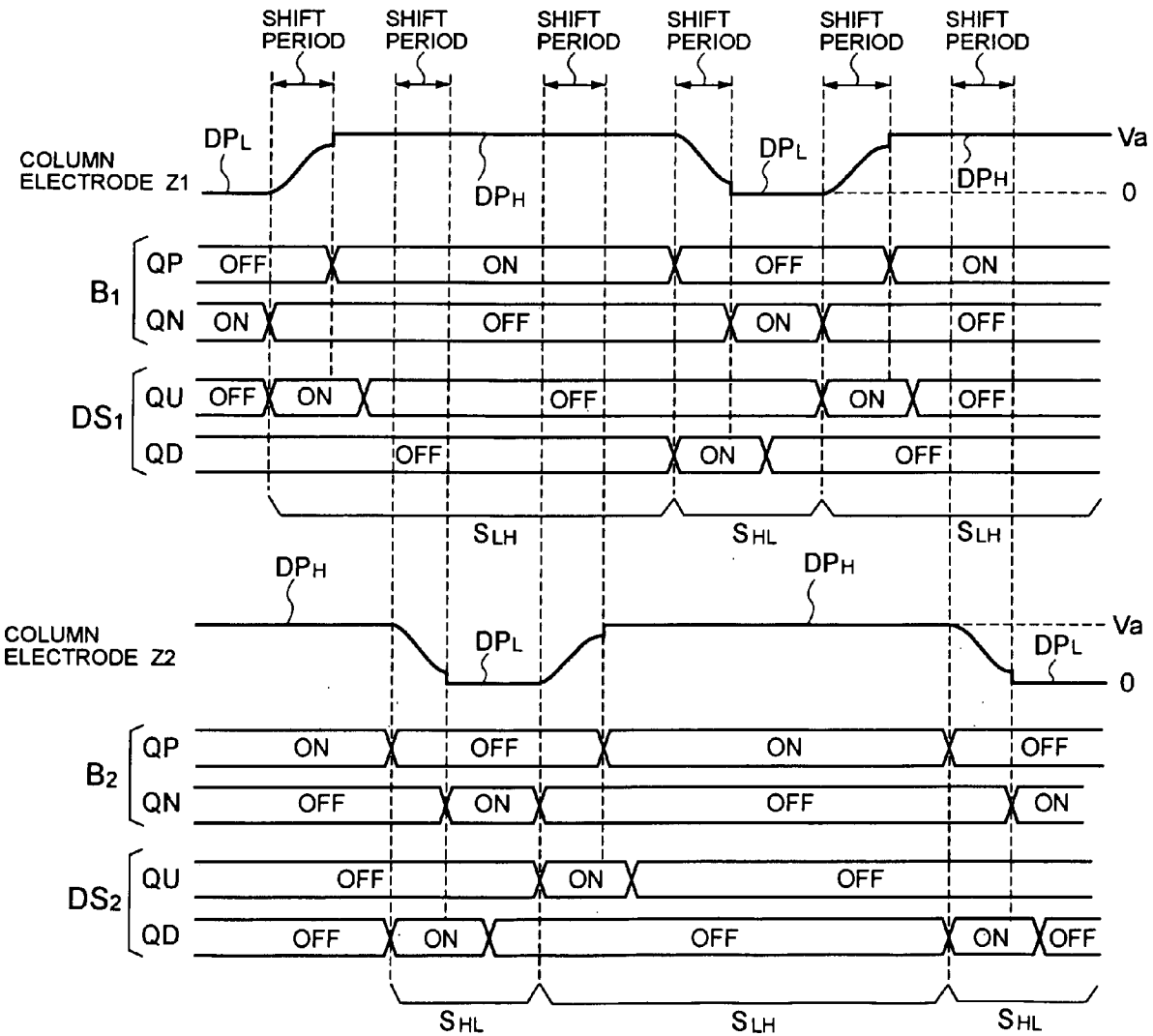
FIG. 7 shows another operation of the electrical charge recovery switch and output buffer.

It should be noted that although the pulse width of the low-voltage pixel data pulse $DP_L$ is wider than that of the high-voltage pixel data pulse $DP_H$ in FIG. 6, the high-voltage pixel data pulse $DP_H$ may have a larger pulse width as shown in FIG. 7.

As understood from the foregoing, the column electrode drive circuit 200 shown in FIG. 3 first determines, for each of the 1st to mth columns of the PDP 10, whether the logic level of each pixel data bit in a series of pixel data bits DB for the column concerned has shifted from 1 to 0 or from 0 to 1.

When it is determined that a pixel data bit DB has shifted from logic level 1 to 0 or from 0 to 1, the transistors QP and QN of the output buffer B associated with the column are both set to the OFF state. Thereafter, the electrical charge recovery operation (switching sequence $S_{HL}$ or $S_{LH}$) by the electrical charge recovery circuit 210 is executed by setting the electrical charge recovery switch DS (either the transistor QU or QD) associated with the column to the ON state over a predetermined period. The leading and trailing edges of the pixel data pulse are generated by means of this electrical charge recovery operation. Then, the electrical charge recovery operation is terminated by setting the electrical charge recovery switch DS (both transistors QU and QD) to the OFF state. Subsequently, the transistor QP or QN of the output buffer B is set to the ON state in accordance with the pixel data bit DB, whereby the power supply voltage Va or 0 volt is applied directly to the column electrode Z over a predetermined interval. Then, the electrical charge recovery operation (switching sequence $S_{HL}$ or $S_{LH}$) by the charge recovery circuit 210 is executed by setting the electrical charge recovery switch DS (either transistor QU or QD) belonging to the column to the ON state once again, whereby the trailing edge or rising edge of the pixel data pulse is generated.

On the other hand, if the logic levels of the series of pixel data bits DB for the column concerned do not change, i.e., if adjacent pixel data bits DB have the same logic level, the electrical charge recovery switch DS belonging to the column is always set to the OFF state. Meanwhile, by setting either the transistor QP or QN of the output buffer B to the ON state in accordance with the pixel data bit DB, the power supply voltage Va or 0 volt is applied to the column electrode Z directly (switching sequence $S_{HH}$ or $S_{LL}$).

Therefore, the column electrode drive circuit 200 shown in FIG. 3 first determines, for each column, whether the string of pixel data bits DB for the column concerned have successively the same logic level, so as to determine whether the voltage of the column electrode Z changes. When the voltage of the column electrode Z changes (from Va to 0 volt or from 0 volt to Va), either the transistor QU or QD of the electrical charge recovery switch DS is set to the ON state so that the electrical charge recovery circuit 210 performs the electrical charge recovery, whereby the trailing edge or rising edge of the pixel data pulse is generated. On the other hand, when the voltage of the column electrode Z does not change, both transistors QU and QD of the electrical charge recovery switch DS are always set to the OFF state so that the electrical charge recovery operation stops. Accordingly, regardless of the nature of the image to be displayed, the resonance circuit, which includes the capacitor C1, coil L and load capacitor $C_0$ of the PDP 10, does not enter a DC drive state, and hence a faulty operation due to the localized heat generation and noises is prevented.

In the column electrode drive circuit 200 shown in FIG. 3, the output buffers $B_1$ to $B_m$ and electrical charge recovery switches $DS_1$ to $DS_m$ are each an IC having a CMOS (Complementary Metal Oxide Semiconductor) structure and provided in the form of an IC package. The electrical charge recovery circuit 210, which includes two discrete components corresponding to the capacitor C1 and the coil L, is externally connected to the discharge/charge terminal TM of the IC package.

Figure 1:
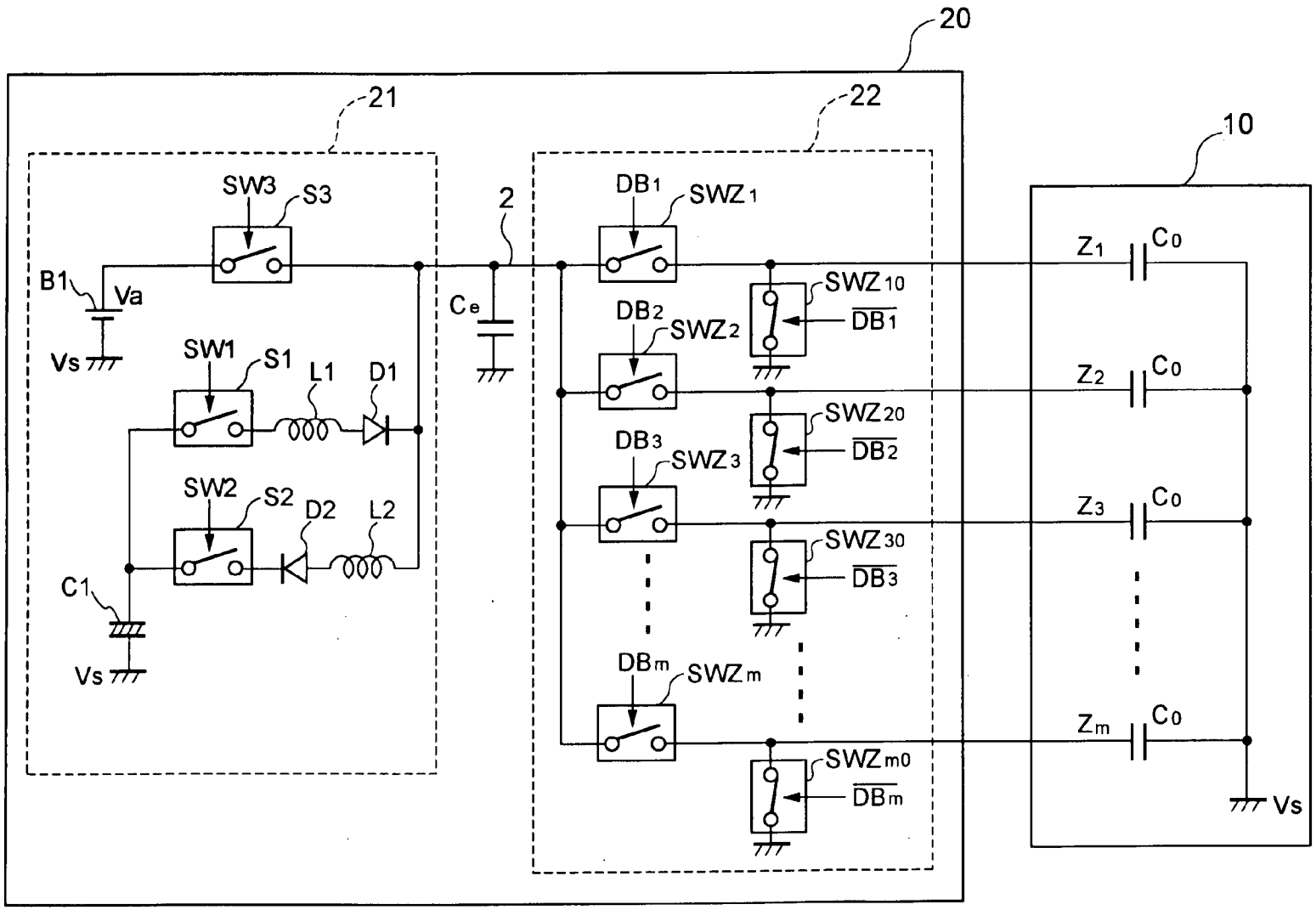
FIG. 1 PRIOR ART
FIG. 1 shows part of a driver device that causes a capacitive display panel to emit light by applying a variety of drive pulses to the capacitive display panel.

Therefore, in comparison with the driver device shown in FIG. 1, the number of externally connected discrete components is reduced, and hence the mounting area and electrical power consumption can be reduced.

The present invention is not limited to the illustrated and described embodiment. For example, although p-channel-type MOS transistors are adopted for the transistors QP, QU and QN in FIG. 3, n-channel-type transistors may be adopted.

In the illustrated embodiment, the drain electrode D of the transistor QU of each electrical charge recovery switch DS is connected to the corresponding column electrode Z and the drain electrode D of the transistor QD of each electrical charge recovery switch DS is connected to the discharge/charge terminal TM. However, the drain electrode D of the transistor QD may be connected to the column electrode Z and the drain electrode D of the transistor QU may be connected to the discharge/charge terminal TM.

In FIG. 6, a predetermined time interval (discrepancy) is provided between the shift period for the column electrode $Z_1$ (trailing edge period) and the shift period for the column electrode $Z_2$ (leading edge period) and between the shift period for the column electrode $Z_2$ (trailing edge period) and the shift period for the column electrode $Z_1$ (leading edge period). Preferably this time interval is shortened as much as possible. For example, the shift period for the column electrode $Z_2$ (leading edge period) is started immediately following completion of the shift period for the column electrode $Z_1$ (trailing edge period), and the shift period for the column electrode $Z_1$ (leading edge period) is started immediately following completion of the shift period (trailing edge period) for the column electrode $Z_2$.

Likewise, in FIG. 7, the shift period for the column electrode $Z_2$ (trailing edge period) may be started immediately following completion of the shift period for the column electrode $Z_1$ (leading edge period), and the shift period for the column electrode $Z_1$ (trailing edge period) may be started immediately following completion of the shift period for the column electrode $Z_2$ (leading edge period).

This application is based on Japanese Patent Application No. 2003-356034 filed on Oct. 16, 2003 and the entire disclosure thereof is incorporated herein by reference.

What is claimed is:

1. A driver device for driving a plurality of capacitive light emitting elements by applying a plurality of drive pulses to the plurality of capacitive light emitting elements respectively via a plurality of drive electrodes in accordance with pixel data derived from an inputted picture signal, the plurality of drive electrodes being associated with the plurality of capacitive light emitting elements respectively, the driver device comprising:

an electrical charge recovery circuit that includes a capacitor and a coil, a reference voltage being applied to one end of the capacitor, and one end of the coil being connected to the other end of the capacitor;

a plurality of electrical charge recovery switches associated with the plurality of drive electrodes respectively, each said electrical charge recovery switch including a first switching element that sends a first current corresponding with electrical charge that has accumulated in the capacitor to the associated drive electrode via the other end of the coil and a second switching element that sends a second current corresponding with electrical charge that has accumulated in the associated capacitive light emitting element to the other end of the coil via the associated drive electrode;

a plurality of output buffers associated with the plurality of drive electrodes respectively, each said output buffer including a third switching element that applies a predetermined high voltage to the associated drive electrode in accordance with the pixel data and a fourth switching element that applies the reference voltage to the associated drive electrode in accordance with the pixel data; and a drive control circuit that determines, for each of the drive electrodes, whether a voltage of the drive electrode concerned has shifted from the high voltage to the low voltage or from the low voltage to the high voltage on the basis of the pixel data, and sets either the first or second switching element of the electrical charge recovery switch associated with the drive electrode concerned, to an ON state over a predetermined period if a voltage shift occurs on the drive electrode concerned, but sets the first and second switching elements of the electrical charge recovery switch associated with the drive electrode concerned to an OFF state if the voltage shift does not occur on the drive electrode concerned.

2. The driver device according to claim 1, wherein each said electrical charge recovery switch and the associated output buffer are integrated into a semiconductor integrated device by means of a single chip.

3. The driver device according to claim 1, wherein in each of the electrical charge recovery switches, the first and second switching elements are connected in series between the associated drive electrode and the other end of the coil.

4. The driver device according to claim 1, wherein the drive control circuit sets the first switching element of one of the electrical charge recovery switches and the second switching element of another one of the electrical charge recovery switch to the ON state at different timings.

5. The driver device according to claim 1, wherein the drive control circuit sets the second switching element of one of the electrical charge recovery switches and the first switching element of another one of the electrical charge recovery switch to the ON state at different timings.

6. The driver device according to claim 1, wherein the drive control circuit sets the third and fourth switching elements of the output buffer both to the OFF state while either the first or second switching element of the electrical charge recovery switch is set to the ON state over the predetermined period.

7. The driver device according to claim 6, wherein one of the third and fourth switching elements is set to the ON state in accordance with the pixel data after the predetermined period has elapsed.

8. The driver device according to claim 1, wherein each of the first and second switching elements includes a transistor with a MOS structure.

9. The driver device according to claim 3, wherein each of the first and second switching elements includes a transistor with a MOS structure.

10. The driver device according to claim 1, wherein the plurality of drive electrodes are column electrodes of a plasma display panel.

11. An apparatus for driving a plurality of capacitive light emitting elements by applying a plurality of drive pulses to the plurality of capacitive light emitting elements respectively via a plurality of drive electrodes in accordance with pixel data derived from an inputted picture signal, the plurality of drive electrodes being associated with the plurality of capacitive light emitting elements respectively, the apparatus comprising:

first means that includes capacitor means and coil means, a reference voltage being applied to one end of the capacitor means, and one end of the coil means being connected to the other end of the capacitor means;

a plurality of second means associated with the plurality of drive electrodes respectively, each said second means including third means for sending a first current corresponding with electrical charge that has accumulated in the capacitor means to the associated drive electrode via the other end of the coil means and fourth means for sending a second current corresponding with electrical charge that has accumulated in the associated capacitive light emitting element to the other end of the coil means via the associated drive electrode;

a plurality of fifth means associated with the plurality of drive electrodes respectively, each said fifth means including sixth means for applying a predetermined high voltage to the associated drive electrode in accordance with the pixel data and seventh means for applying the reference voltage to the associated drive electrode in accordance with the pixel data; and eighth means for determining, for each of the drive electrodes, whether a voltage of the drive electrode concerned has shifted from the high voltage to the low voltage or from the low voltage to the high voltage on the basis of the pixel data, and for setting either the third or fourth means of the second means associated with the drive electrode concerned, to an ON state over a predetermined period if a voltage shift occurs on the drive electrode concerned, but sets the third and fourth means of the second means associated with the drive electrode concerned to an OFF state if the voltage shift does not occur on the drive electrode concerned.

12. The apparatus according to claim 11, wherein each said second means and the associated fifth means are integrated into a semiconductor integrated device by means of a single chip.

13. The apparatus according to claim 11, wherein the third and fourth means in each said second means are connected in series between the associated drive electrode and the other end of the coil means.

14. The apparatus according to claim 11, wherein the eighth means sets the third means of one said second means and the fourth means of another said second means to the ON state at different timings.

15. The apparatus according to claim 11, wherein the eight means sets the fourth means of one said second means and the third means of another said second means to the ON state at different timings.

16. The apparatus according to claim 11, wherein the eighth means sets the sixth and seventh means of the fifth means both to the OFF state while either the third or fourth means of the second means is set to the ON state over the predetermined period.

17. The apparatus according to claim 16, wherein one of the sixth and seventh means is set to the ON state in accordance with the pixel data after the predetermined period has elapsed.

18. The apparatus according to claim 11, wherein each of the third and fourth means includes a transistor with a MOS structure.

19. The apparatus according to claim 13, wherein each of the third and fourth means includes a transistor with a MOS structure.

20. The apparatus according to claim 11, wherein the plurality of drive electrodes are column electrodes of a plasma display panel.

* * * * *